US005474211A

United States Patent [19]

Hellenberg

[11] Patent Number: 5,474,211

[45] Date of Patent: Dec. 12, 1995

[54] METHOD OF DISPENSING MATERIALS WITH IMPROVED ACCURACY

[76] Inventor: Leendert Hellenberg, Poelweg 22, 2361 LK Warmond, Netherlands

[21] Appl. No.: 335,181

[22] Filed: Nov. 7, 1994

Related U.S. Application Data

[63] Continuation of Ser. No. 36,052, Mar. 23, 1993, abandoned.

[51] Int. Cl.[6] ..... B67D 5/52

[52] U.S. Cl. ..... 222/1; 222/135; 222/144; 222/144.5; 222/168; 222/380; 141/104

[58] Field of Search ..... 222/1, 14, 135, 222/144, 144.5, 168, 380; 141/103, 104, 105; 366/605

[56] References Cited

U.S. PATENT DOCUMENTS

| | | | |
|---|---|---|---|
| 2,787,402 | 4/1957 | Stiner et al. | 222/76 |
| 2,848,019 | 8/1958 | Corbin et al. | 141/100 |
| 3,015,415 | 1/1962 | Marsh et al. | 222/14 |
| 3,023,936 | 3/1962 | Marsh et al. | 222/235 |
| 4,027,785 | 6/1977 | Edstrom et al. | 222/135 |
| 4,258,759 | 3/1981 | Achen | 141/100 |
| 4,813,785 | 3/1989 | Miller | 366/251 |
| 4,913,202 | 4/1990 | Miller et al. | 222/135 X |
| 4,953,985 | 9/1990 | Miller | 366/244 |
| 4,967,938 | 11/1990 | Hellenberg | 222/144 |
| 5,078,302 | 1/1992 | Hellenberg | 222/144 |
| 5,119,973 | 6/1992 | Miller et al. | 222/144 |

*Primary Examiner*—Andres Kashnikow
*Assistant Examiner*—Joseph A. Kaufman
*Attorney, Agent, or Firm*—Fitch, Even, Tabin & Flannery

[57] ABSTRACT

Dispensing mechanism includes a plurality of storage containers, each container having two or more metering pumps associated therewith. The containers and metering pumps are located on a turntable which is indexed to move a particular metering pump to a dispensing station. Automated dispensing equipment operate the metering pump at the dispensing station and the turntable is thereafter indexed a smaller amount to bring the other pump associated with the same container into a dispensing position. In this manner, a single actuator system can be employed for multiple discharge cycles associated with a particular canister, and can accommodate multiple canisters.

5 Claims, 6 Drawing Sheets

METHOD OF DISPENSING MATERIALS WITH IMPROVED ACCURACY

This application is a continuation of application Ser. No. 08/036,052, filed Mar. 23, 1993, now abandoned.

BACKGROUND OF THE INVENTION

1. Field of the Invention

The present invention pertains to dispensing apparatus for liquid and pulverulent materials, and more particularly to such apparatus which is suitable for automated operation.

2. Description of the Related Art

Automated dispensing apparatus for pulverulent materials, such as food flavorings, chemical additives, paints, paint colorants and inks, for example, are becoming increasingly popular. Automatic dispensing machines have been developed for dispensing a plurality of different materials into a common container. These systems typically employ separate independent sources of material to be dispensed, with individual discharge mechanisms associated with their respective materials.

Examples of such apparatus are disclosed in commonly assigned U.S. Pat. Nos. 4,967,938 and 5,078,302. Formulations are stored in a digital computer or similar control device. Valve operating and pump operating equipment is provided at a dispensing station, located at a point adjacent a turntable carrying containers which hold the different materials. The valve operating and pump operating equipment is coupled to the computer. An operator selects a particular formula (e.g., by name) from a list of formulas stored in the computer. When the formulation is identified, the computer indicates the first canister to be selected. For example, when the material being dispensed is a coloring, such as a tint for a paint base, the computer identifies which color tint is to be dispensed first.

The container may simply be identified on an output device, such as a cathode ray tube, with the system pausing until confirmation by the operator that the particular canister is in the desired position, or alternatively, the control system may index the turntable automatically, to bring the canister to the dispensing station. An example of a semi-automatic dispensing apparatus in which the turntable is manually indexed by an operator is described in commonly assigned U.S. Pat. No. 5,119,973. When the container is in place, the computer then directs the valve operator to open necessary valves for a dispensing operation and to prepare the pump operator for a pumping stroke. Under computer control, the pump associated with each container is operated so as to discharge an amount called for by the selected formula. After the pumping operation is completed, the computer calls for closing of the necessary valves, and the cycle is repeated for a second container (e.g., a second color tint to be added to the paint base). As with the fully automatic systems, the valve operation and pump operation of U.S. Pat. No. 5,119,973 is under computer control.

In each of the above-mentioned United States Letters Patent, a single dispensing pump is associated with each storage container. Commonly assigned U.S. Pat. No. 4,027,785 discloses a dual pump colorant dispenser offering improved metering accuracy, with a large pump dispensing large quantities of material, and a small pump dispensing small quantities of material so as to more accurately achieve a total dispensed amount. However, the dual pump dispenser has been developed for and has found ready commercial acceptance as a manually operated device.

Improvements are still being sought in automatic dispensing equipment, and it would be desirable to provide improved metering accuracy with a minimum of development time and cost of production.

SUMMARY OF THE INVENTION

It is an object according to the present invention to provide automated dispensing apparatus having improved dispensing accuracy.

Another object of the present invention is to provide apparatus for dispensing a plurality of different materials into a common receptacle.

Yet another object according to principles of the present invention is to provide automated dispensing apparatus having dual pump dispensers for the various materials being dispensed.

These and other objects according to principles of the present invention, which will become apparent from studying the appended description and drawings, are provided in apparatus for dispensing a target amount of a material to a receptacle, comprising:

at least one material source for holding the material to be dispensed;

at least two discharge means coupled to said at least one material source and operable by an actuator means, for discharging from said at least one material source preselected different amounts of material, each less than said target amount;

actuator means for actuating said discharge means in response to a command signal;

movable support means carrying said discharge means to and from said actuator means;

drive means for moving said movable support means so as to carry preselected ones of said discharge means to said actuator means in response to a drive signal; and control means coupled to said actuator means for sending said command signal thereto and further coupled to said drive means for sending said drive signal thereto, said control means operable to send a first drive signal to said drive means so as to carry one of said discharge means to said actuator means and so as to send a first command signal to discharge a first preselected amount of material, less than said target amount, therefrom and to thereafter send a second drive signal to said drive means so as to move said movable support means so as to carry the other of said discharge means to said actuator means and so as to send a second command signal to discharge a different preselected amount of material, less than said target amount, therefrom so that the amounts of material dispensed combine to achieve the target amount with an improved accuracy.

DETAILED DESCRIPTION OF THE PREFERRED EMBODIMENT

Figure 1:
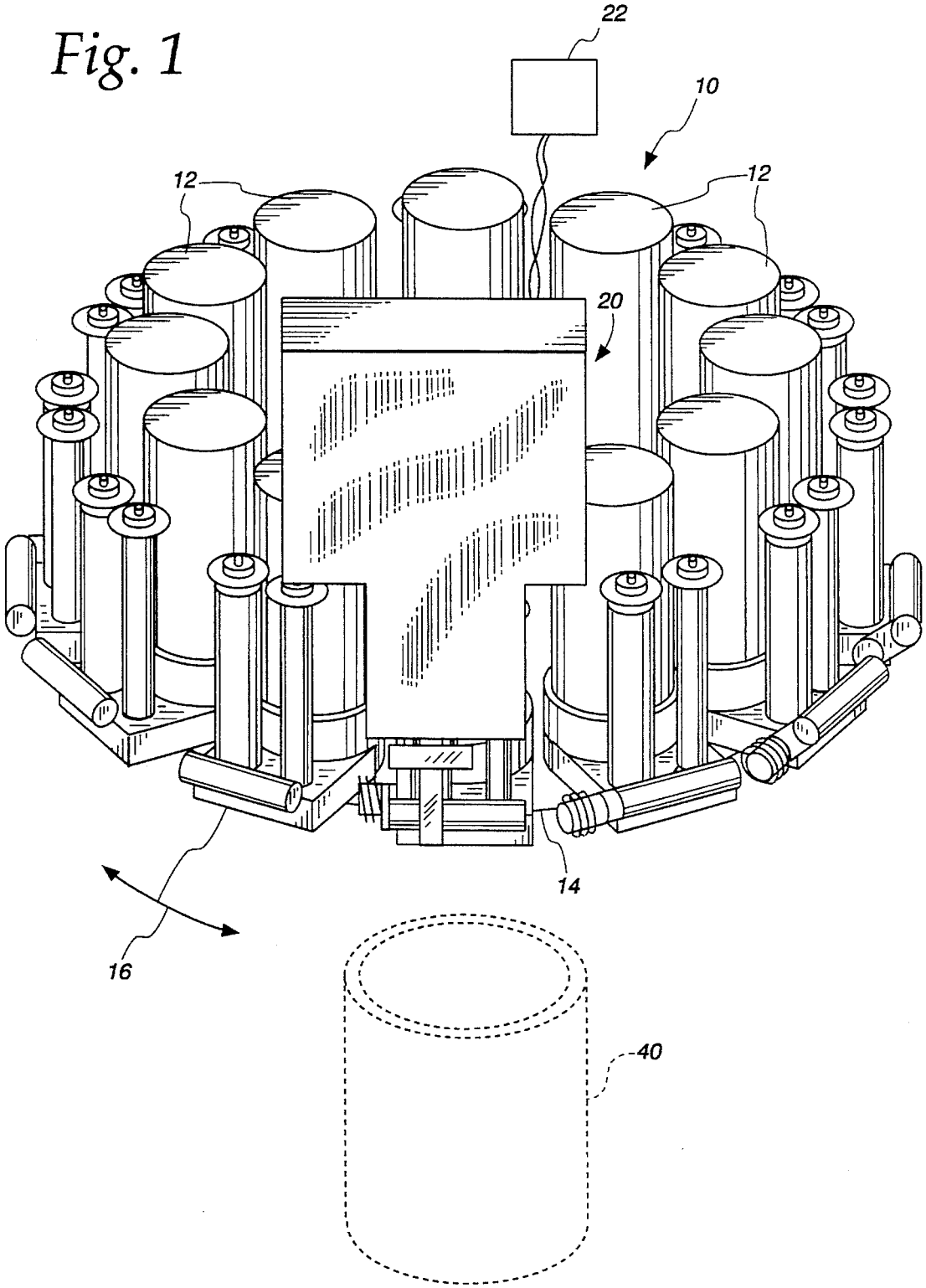
FIG. 1 is a perspective view of dispensing apparatus according to principles of the present invention.

FIG. 1 shows dispensing apparatus according to principles of the present invention, wherein a plurality of storage containers or canisters 12 are mounted on a turntable 14, which rotates in the direction of double-headed arrow 16. A stationary dispensing station generally indicated at 20 includes automated pump and valve actuators under control of a digital microcomputer, analog circuitry, or other control device 22.

Figure 2:
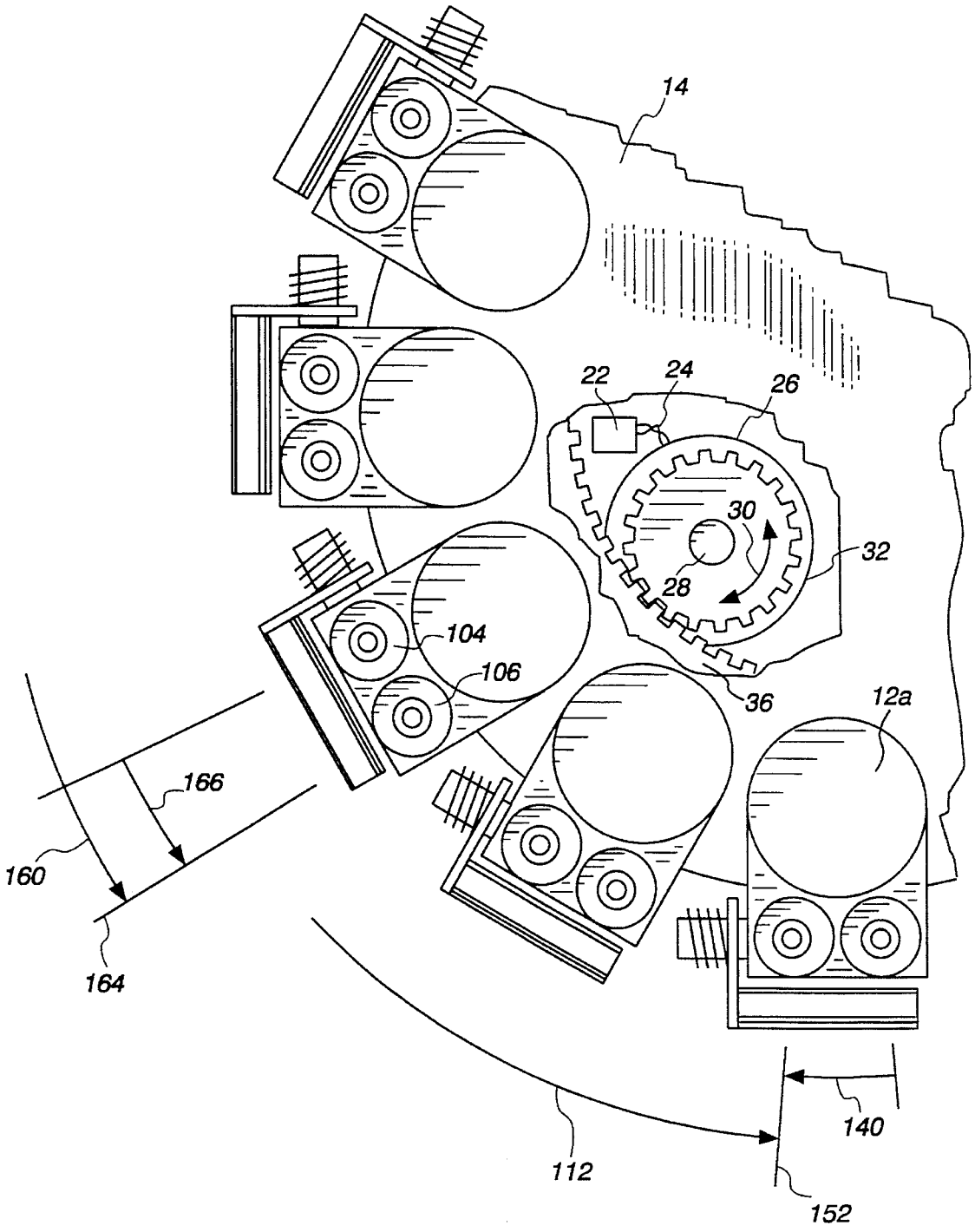
FIG. 2 is a fragmentary top plan view thereof.

Referring additionally to FIG. 2, the control device 22 is also coupled through conductors 24 to a drive motor 26 having an output shaft 28. The motor 26 drives the shaft 28 in opposite directions, as indicated by double-headed arrow 30. A gear 32 attached to the output shaft 28 engages a gear ring 36 which is attached to turntable 14. By sending drive signals to motor 26, the control device 22 causes the output shaft, and hence gear 32, to rotate in opposite directions, indicated by arrow 30. This, in turn, causes turntable 14 to rotate in the directions indicated by arrow 16 in FIG. 1. The control system 22 indexes turntable 14 to present a particular canister to the dispensing station 20, as called for in a program stored in the control device. In the preferred embodiment, the control device 22 comprises a digital microcomputer, and the program referred to herein is preferably stored on a floppy disk and installed in the microcomputer to be called on demand by an operator. In the preferred embodiment, the operator is given a menu choice of different formulations to be dispensed.

The dispensing apparatus of the present invention has found ready commercial acceptance in the paint industry, and has been directed to dispensing different colored tint materials into a container 40 of paint base material (see FIG. 1). The control device 22 presents a menu of final paint colors to an operator, who selects the desired color. The control device then calls up the formulation associated with the paint color, and calls for the dispensing of the required paint tints stored in canisters 12, one canister at a time.

The control device identifies and calls for a first canister to be brought to the dispensing station 20. Drive signals are sent through conductors 24 to turntable drive motor 26, which indexes turntable 14 as required to bring a particular canister to the dispense station. Automated devices, to be explained herein, automatically dispense a desired quantity of material from the canister into the receptacle or container 40, and the program identifies the next colorant to be added to the container. The control device then sends drive signals to motor 26 to index the turntable 14 to present a second desired canister to the dispensing station 20. The dispensing cycle is then repeated with the turntable being indexed the required number of times until all of the different paint tints are dispensed into the container 40. The container (with its paint base and paint tint material) is then sealed and mixed to provide the desired paint color in the amount indicated by the operator of the dispensing apparatus.

Figure 4:
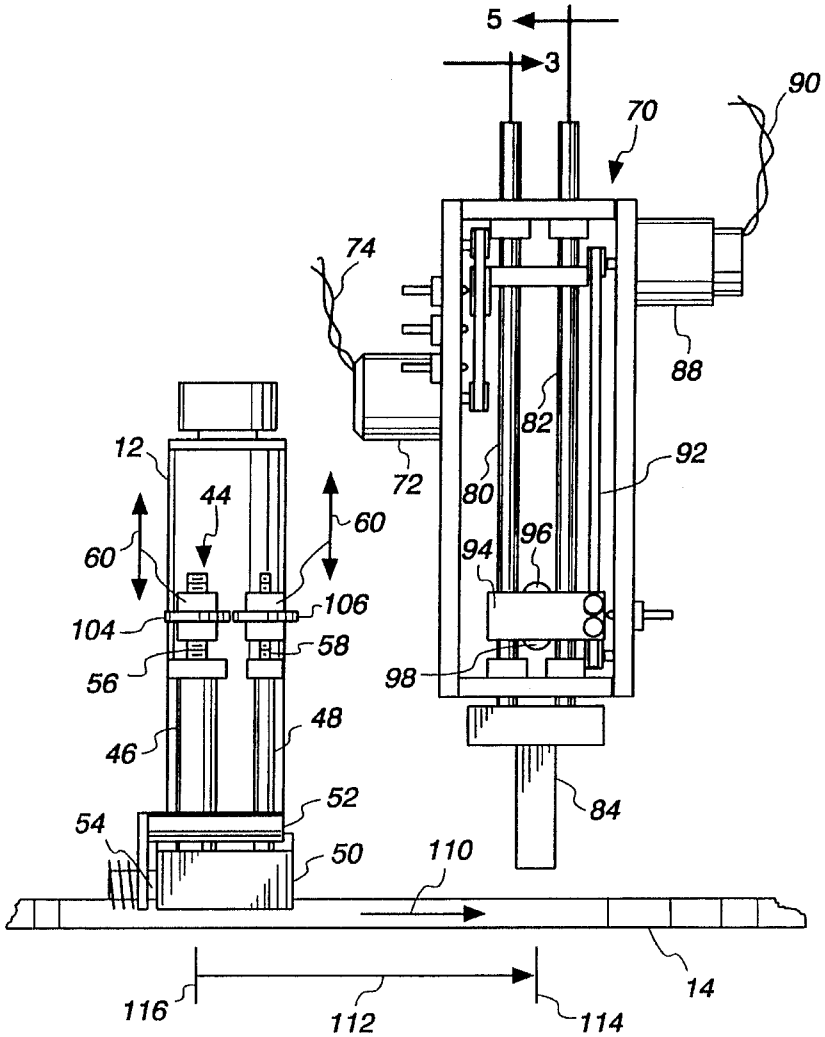

As will be seen herein, improved dispensing accuracy is provided with dual pumps associated with each canister 12. Referring to FIG. 4, for example, a typical canister 12 has associated therewith a discharge system, generally indicated at 44, which includes a larger metering pump 46 and a smaller metering pump 48, each coupled to the same canister 12. The metering pumps are mounted in a valve block 50 containing valve mechanisms for controlling the flow of metered material. A handle 52 is mounted for rotation about a shaft 54. When rotated, the handle 52 opens and closes a path of travel for the dispensed material, allowing the material to flow to a position below the valve block 50.

The pumps 46, 48 include shafts 56, 58 which reciprocate in the direction of double-headed arrows 60 so as to suction and to eject under pressure, desired quantities of materials stored in canister 12. The amount of the material dispensed by the metering pumps depends upon the amount of travel of the shafts 56, 58, respectively, and automated equipment is provided for reciprocation of the pump shafts in the amount required to achieve a desired discharge volume.

Referring again to FIG. 4, an actuator system generally indicated at 70 is mounted in a stationary position at the dispensing station 20. The actuator system 70 includes a first drive motor 72 coupled through conductors 74 to control device 22. The drive motor 72 drives rods 80, 82 in vertical directions, moving the valve engagement tool 84 between the two operating positions shown in FIG. 5 and FIG. 17, associated with closed and open valve positions, respectively. The actuator system 70 further includes a pump actuator motor 88 coupled through conductors 90 to control system 22. Motor 88 drives cog belt 92, so as to raise and lower pump operator tool 94.

Figure 5:
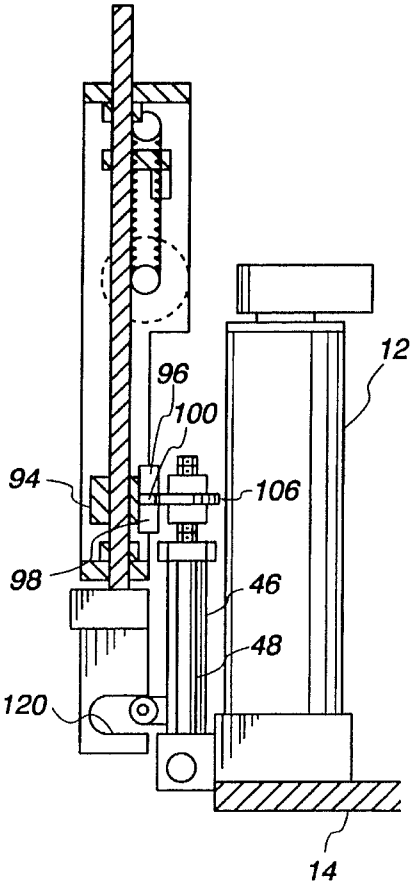
FIGS. 3–17 are fragmentary front elevational and side elevational views thereof, showing a sequence of operation.
Figure 3:
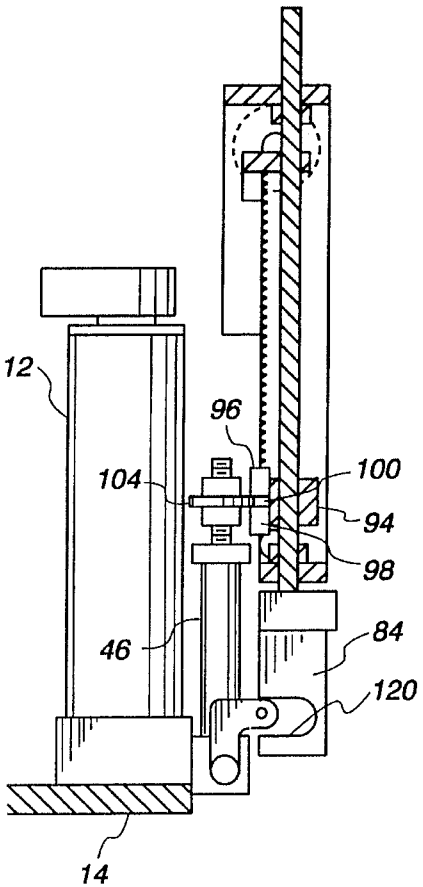

As shown in FIGS. 3 and 5, for example, the pump operator tool 94 includes a pair of vertically spaced rollers 96, 98, which are free to rotate about their respective mounting shafts, which extend in generally horizontal directions. A gap or nip 100 is formed between the rollers 96, 98. Referring again to FIG. 4, washers 104, 106 are secured to shafts 56, 58, respectively, and are secured thereto with nut fasteners. As turntable 14 is rotated, washers 104, 106 pass through the nip 100 and, as will be seen, when a desired canister is located in position at the dispensing station, either washer 104 or washer 106 will be received in the nip 100, held captive between the rollers 96, 98. With reciprocation of the cog belt 92, the rollers 96, 98 and the washer held captive therebetween are raised and lowered, upon the issuance of command signals to pump actuator motor 88. This in turn reciprocates the piston rods 56, 58 of the metering pumps.

Figure 7:
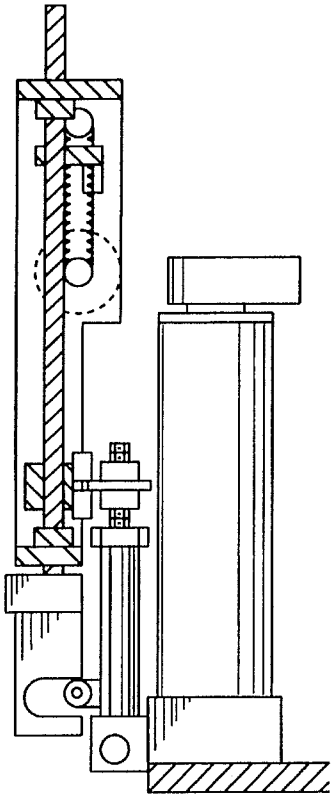
Figure 6:
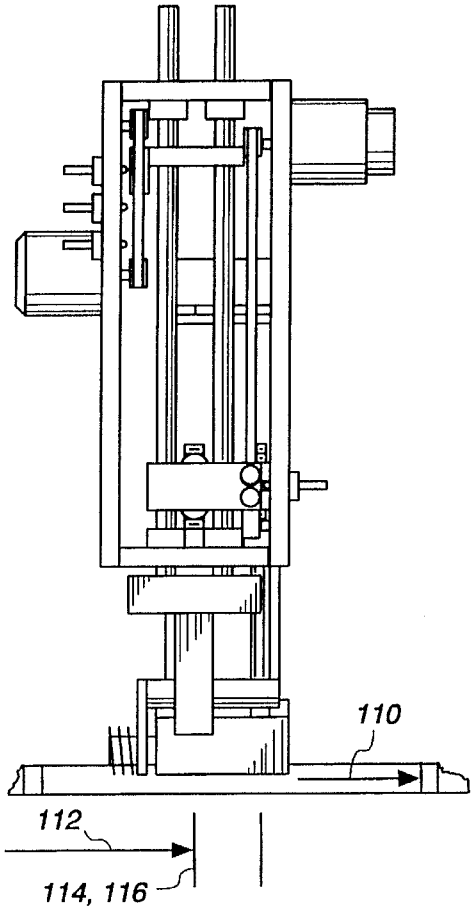
Figure 13:
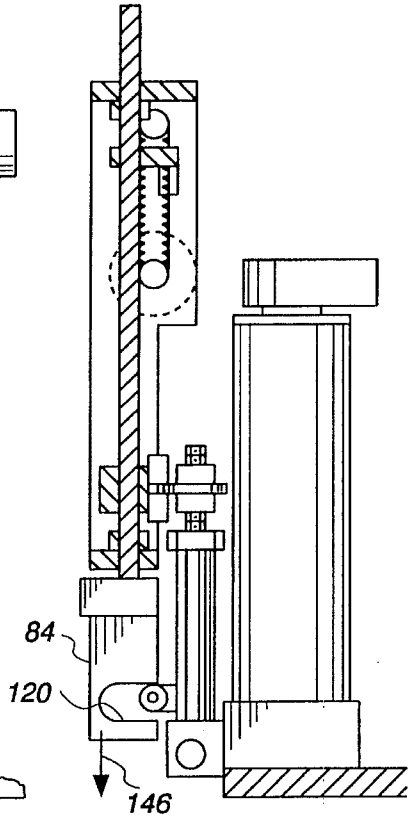

Referring to FIG. 4, turntable 14 is being rotated in the direction of arrow 110 so as to bring the cylinder 12 and its related dual pumps into position at the dispensing station, the centerline of which is indicated by reference line 114, a line passing through the central plane of the valve and pump operator tools. According to one aspect of the present invention, the cylinder 12 is advanced to the dispensing station such that one or the other of its differently sized pumps are aligned with the valve and pump operator tools. As indicated in FIG. 4, reference line 116 is located at the center of the larger metering pump 46, and turntable 14 is advanced until the reference line 116 is located at the reference line 114, with the larger metering pump 46 being located in the desired operating position at the dispense station. As contemplated herein, the operating position of the cylinder and its related equipment is one in which the valve handle 52 is located within the recess 120 of valve operator tool 84 and with washer 104 located in the nip between rollers 96, 98. FIGS. 6 and 7 also show the larger metering pump 46 in operating position at the metering station.

Figure 9:
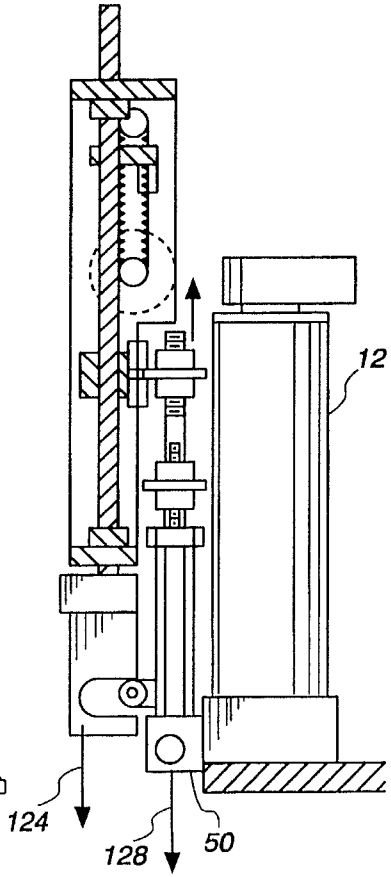
Figure 17:
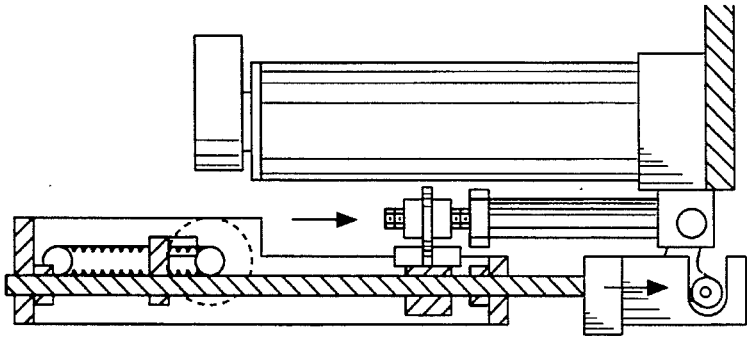
Figure 16:
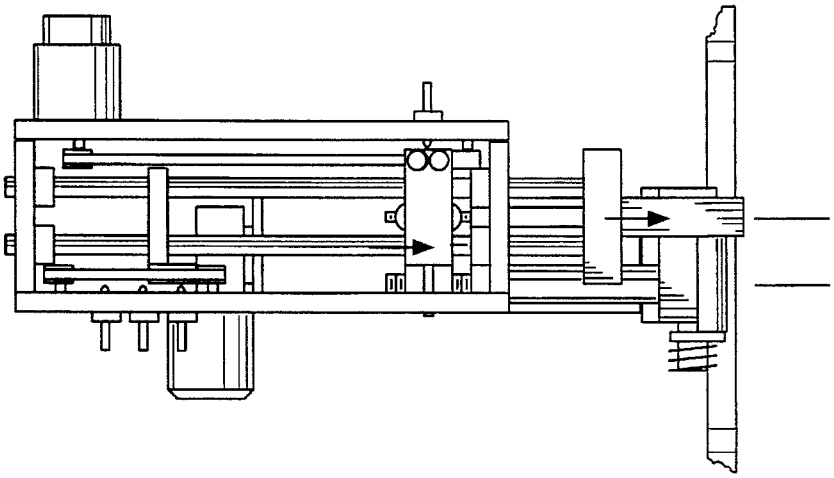

Next, the valve operator tool 84 is lowered in the direction of arrow 124 to the position illustrated in FIG. 17, for example. This action opens the valving within valve block 50 and clears a passageway for discharge of colorant material, in the direction of arrow 128 shown in FIG. 9. To achieve a discharge of material, positive and negative pressures are developed in the metering pump 46 which forces material in container 12 into and out of metering pump 46 through a discharge nozzle to exit the valve block 50, as shown by arrow 128. As shown in FIGS. 3–7, for example, the pump pistons 56, 58 are fully depressed, with the metered volume in each pump being nil.

Figure 8:
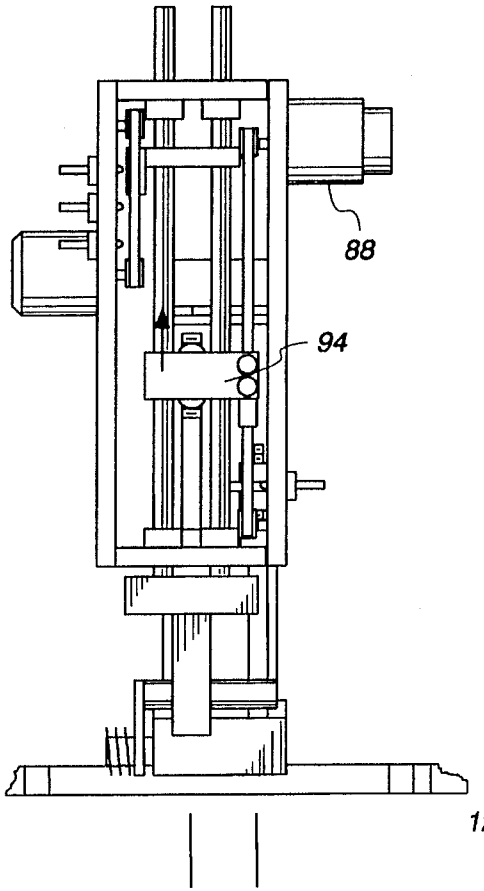
Figure 11:
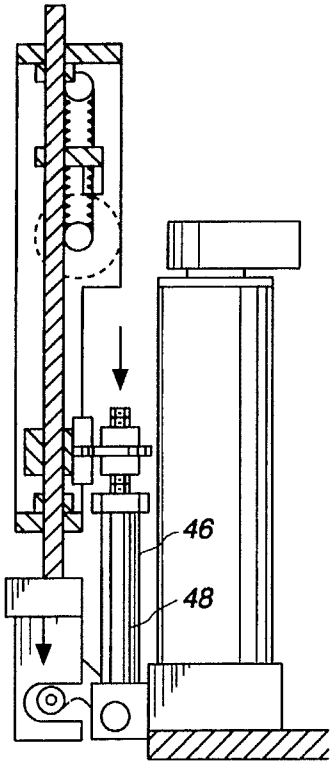
Figure 10:
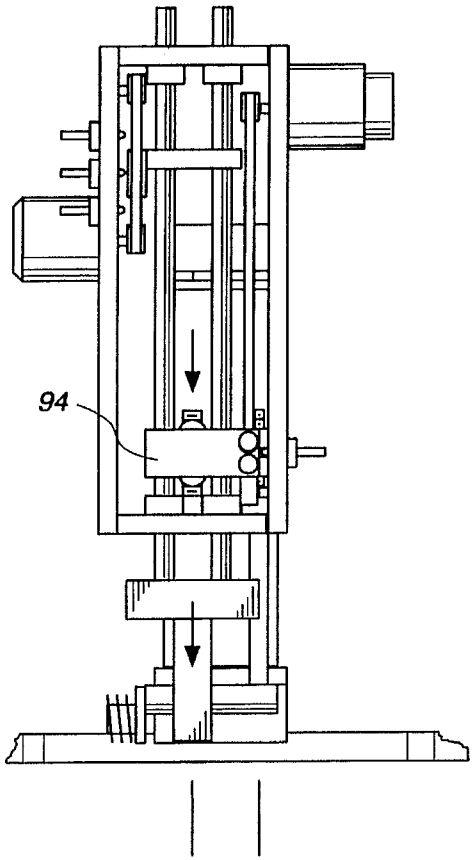

As indicated in FIG. 8, the drive motor 88 has been energized so as to raise the pump operating tool 94, thereby raising the washer 104 attached to metering pump rod 56. This raises the plunger within the metering pump, filling the pump with a predetermined metered volume, proportional to the height of washer 104. Referring to FIGS. 10 and 11, the command signals to drive motor 88 are changed so as to cause a downward displacement of the pump operator tool 94, emptying the metered contents of pump 46. Thus, a first, larger quantity of material is dispensed with a complete cycle of operation of pump 46.

According to one aspect of the present invention, the full desired ("target") amount of material is not dispensed with operation of pump 46, but requires a cycle of operation of the smaller metering pump 48. If desired, in some applications, operation of smaller pump 48 can be omitted and a canister containing a different colorant material can be moved to the dispensing station. However, in many dispensing operations, the metering accuracy requires that at least a small amount of material be dispensed by the smaller metering pump 48. Accordingly, referring to FIG. 12, turntable 14 is rotated a relatively slight amount, as indicated by arrow 140, so as to bring the smaller metering pump 48 into an operating position at the dispensing station, with washer 106 held captive between the rollers 96 and 98, and with handle 52 received in the recess 120 of valve operator tool 84.

Figure 15:
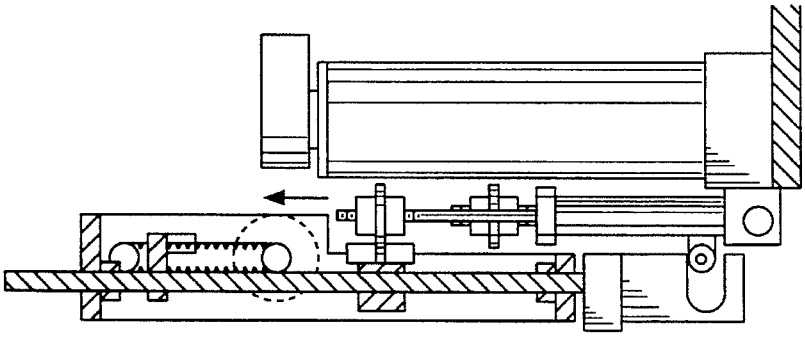
Figure 14:
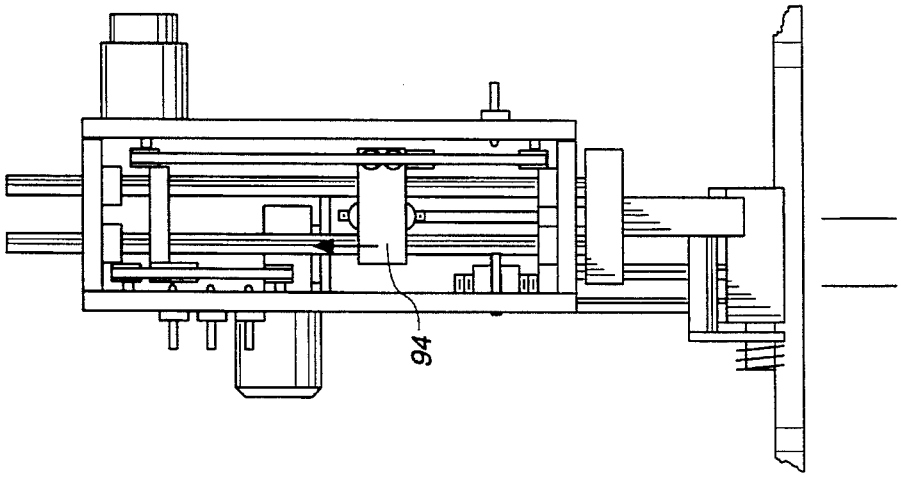

A second pump operating cycle similar to that described above with reference to FIGS. 8–11 is repeated in the manner indicated in FIGS. 14–17 to discharge a metered amount of material from the smaller metering pump 48. FIGS. 14 and 15 show the raising of the pump operator tool 94 so as to suction material from valve block 50 from canister 12, filling the metered chamber within pump 48. Command signals to drive motor 88 are reversed, and pump piston 58 is lowered to discharge the metered amount of materials through the valve block. FIG. 17 shows the handle 52 depressed so as to open the discharge passageways through valve block 50. Upon conclusion of the pumping cycle, command signals are sent to drive motor 72, raising the valve operator tool 84 and closing the valving with valve block 50.

The actuator system described above is the same as that shown and described in U.S. Pat. No. 5,119,973, the disclosure of which is herein incorporated by reference as if fully set forth herein. An example of the control system is also given in this patent, with the notable exception that the present invention is directed to dual metering pumps whereas U.S. Pat. No. 5,119,973 is concerned only with a single metering pump associated with each canister. Other examples of actuator systems are shown in U.S. Pat. Nos. 4,967,938 and 5,078,302, also commonly assigned, and the disclosures thereof are also incorporated by reference herein as if fully set forth herein.

Details concerning the operation of the dual metering pumps and of the valve block 50 may be found in commonly assigned U.S. Pat. No. 4,027,785, the disclosure of which is incorporated herein as if fully set forth herein. One notable difference is that the dual pumps of the patent are manually actuated, although other details concerning the operation of the dual pump colorant dispenser are present in the preferred embodiment of the present invention. As will now be appreciated, the present invention can be readily practiced in a commercial environment using a number of existing, proven systems which do not require extended evaluation efforts.

Figure 12:
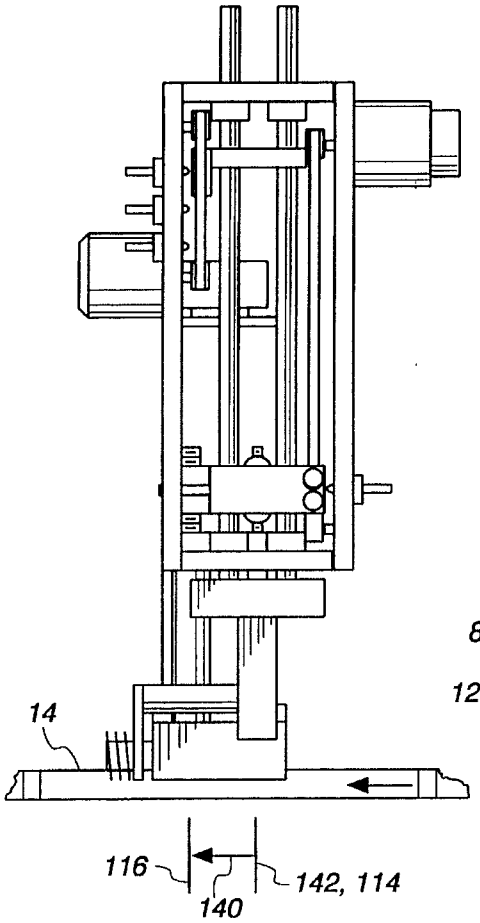

Referring again to FIG. 2, the reference arrows 112, 140 of FIGS. 4, 12, respectively, are shown to indicate a sequence of operation associated with a first canister 12*a*. To complete a dual pumping cycle for the metering pumps associated with canister 12*a*, the direction of rotation of turntable 14 is reversed to bring the smaller metering pump 48 into position along a reference line 152. Other variations are, of course, possible. For example, the relative locations of the larger and smaller metering pumps 46, 48, can be reversed if it is desired to discharge the smaller metered amount using the operating pattern indicated by arrows 112, 140.

As a further alternative, the sequence of operation can be altered, with turntable 14 being rotated as indicated by reference arrow 160 to bring the smaller metering pump 48 into position at a reference line 164. After the dispensing operation is completed, the turntable 14 is advanced in the same rotational direction, as indicated by reference arrow 166, to bring the larger metering pump into position at the reference line 164. It is assumed, in providing a practical operating mode, that reference line 164 will be made to correspond to the reference line of a dispensing station, e.g., the reference line 146 shown in FIG. 4. Again, if desired, the larger and smaller metering pumps can be reversed.

As can be seen from FIG. 2, the metering pumps associated with a particular canister are spaced much closer to each other than the spacing between adjacent canisters. Thus, operation in a complete dispensing cycle usually involves indexing the turntable 14 with a first, larger rotational displacement to bring a first metering pump into position at a dispensing station, and then a much smaller rotational displacement to bring the second metering pump associated with the same canister into position at the dispensing station. Put another way, it is preferred that the canisters are spaced apart on turntable 14 with a certain preselected minimum spacing, and with the metering pumps associated with a particular canister being spaced from each other with a much smaller spacing. This results in a minimal disturbance of the relative alignment between moving and stationary parts for a discharge associated with a particular canister. Thus, the accuracy of the metered dispensing of the multiple metering pumps associated with a particular canister are held to very low tolerances, an important factor for newer painting formulations which require more concentrated tinting materials which much be dispensed in smaller-than-usual quantities. Although the relatively large rotational displacements associated with bringing a different canister into position at a dispensing station cannot be avoided, optimization of the metering accuracy associated with a particular canister is maintained at a high level.

Other alternatives are also possible. For example, a rotating turntable has been described above. However, it should be understood that the present invention also pertains to arcuate and linear reciprocating tables which carry the canisters and metering pumps described above, and wherein full rotations of the table are not required. Further, the source of material, i.e., the canisters 12, are described above as being carried along adjacent the pairs of metering pumps, it is possible, especially with non-rotating tables, that the canisters are remotely located from the metering pumps and may even be fixed in position being coupled, for example, with flexible tubing to their associated metering pumps. These latter arrangements can be conveniently provided with tables which reciprocate in a linear or in arcuate fashion. Further, although the canisters and metering pumps have been described as being mounted on a horizontally extending turntable, it is possible that the equipment can also be located on a vertical "table" which is displaced in vertical direction to bring the various metering pumps to a dispensing station.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Method for dispensing target amounts of various materials to a receptacle, comprising:

arranging a plurality of material sources for holding the materials to be dispensed about a dispensing station;

providing multiple sets of discharge means, each set containing a larger and a smaller discharge means;

coupling said discharge means to said material sources such that each said set of discharge means is operable by an actuator means for discharging preselected different amounts of material from said material sources, each amount less than said target amount;

actuating said discharge means with said actuator means at said dispensing station in response to a command signal;

carrying said discharge means to and from said actuator means with movable support means;

spacing said sets of discharge means apart on said movable support means with a preselected minimum spacing, while spacing the discharge means of each set apart from one another with a smaller spacing;

moving said movable support means with a drive means so as to carry preselected ones of said discharge means to said actuator means in response to a drive signal;

sending said command signal via a control means to said actuator means;

sending said drive signal to said drive means via the control means; and said control means sending a plurality of signals, including a first drive signal to said drive means so as to carry one of said discharge means of a set to said actuator means, a first command signal to discharge a first preselected amount of material, less than said target amount, therefrom, a second drive signal thereafter sent to said drive means so as to move said movable support means so as to carry the other of said discharge means of the same set to said actuator means and to send a second command signal to said actuator means to discharge a different preselected amount of material, less than said target amount, therefrom, so that the amounts of material dispensed combine to achieve the target amount with an improved accuracy.

2. The method of claim 1 further comprising the steps of issuing the first drive signal to move a preselected set of discharge means to said dispensing station with one of said larger and said smaller discharge means positioned at the dispensing station; and thereafter issuing the second drive signal to position the other of said larger and said smaller discharge means at the dispensing station to complete the dispensing operation.

3. The method of claim 1 wherein the step of coupling said discharge means comprises the step of coupling said sets of discharge means to respective ones of said material sources.

4. The method of claim 1 wherein said movable support means comprises a turntable, the method further comprising the step of angularly displacing said sets of discharge means from one another by at least a first amount, with angular displacements measured from the center of the turntable.

5. The method of claim 1 further comprising the step of angularly displacing said discharge means of each set from one another, with angular displacements smaller than the first amount also measured from the center of the turntable.

* * * * *